US005530206A

United States Patent [19]

Robert et al.

[11] Patent Number: 5,530,206

[45] Date of Patent: Jun. 25, 1996

[54] TELECOMMUNICATION CABLE

[75] Inventors: Lydie Robert, Marcoussis; Frédéric Heliodore, Paris; Stanislas Galaj, Arcueil; Alain Le Mehaute, Gif Sur Yvette, all of France

[73] Assignee: Alcatel Cable, Clichy Cedex, France

[21] Appl. No.: 239,554

[22] Filed: May 9, 1994

[30] Foreign Application Priority Data

May 10, 1993 [FR] France ..... 93 05582

[51] Int. Cl.[6] ..... H01B 7/34

[52] U.S. Cl. ..... 174/102 SC; 174/36; 174/120 SC

[58] Field of Search ..... 174/102 SC, 36, 174/120 SC, 105 SC

[56] References Cited

U.S. PATENT DOCUMENTS

| | | | |
|---|---|---|---|
| 3,749,817 | 7/1973 | Shiga et al. | 174/102 SC |
| 4,079,192 | 3/1978 | Josse | 174/126 CP |
| 4,301,428 | 11/1981 | Mayer | 333/12 |
| 4,487,996 | 12/1984 | Rabinowitz et al. | 174/105 R |
| 4,556,860 | 12/1985 | Tobias et al. | 338/22 SD |
| 4,801,766 | 1/1989 | Aida et al. | 174/120 SC |
| 4,988,949 | 1/1991 | Boenning et al. | 174/120 SC |
| 5,132,490 | 7/1992 | Aldissi | 174/36 |

FOREIGN PATENT DOCUMENTS

| | | |
|---|---|---|
| 0190939A3 | 8/1986 | European Pat. Off. . |
| 0190940A3 | 8/1986 | European Pat. Off. . |

*Primary Examiner*—Morris H. Nimmo

*Attorney, Agent, or Firm*—Sughrue, Mion, Zinn, Macpeak & Seas

[57] ABSTRACT

A coaxial cable intended to be used in the field of telecommunications comprises a metal core surrounded by at least two layers one of which is a dielectric material layer and the other of which, disposed between the core and the dielectric material layer over at least part of the length of the cable, is a semiconductor composite material layer comprising an insulative matrix and an undoped polymeric conductor containing conjugate bonds. The cable features intrinsic filtering of electromagnetic interference conducted by the cable at frequencies below 1 GHz.

20 Claims, 2 Drawing Sheets

TELECOMMUNICATION CABLE

BACKGROUND OF THE INVENTION

1. Field of the Invention

The present invention concerns a cable more particularly intended to be used in the field of telecommunications where the wanted signal conveyed is a low energy signal.

2. Description of the Prior Art

Cables connecting different systems convey a wanted signal that may be a direct current or alternating current signal but also convey electromagnetic interference at varying frequencies, these frequencies increasing all the time as data rates increase.

Protecting electronic systems from electromagnetic interference conducted by the connecting cables has become essential to achieve correct operation in a polluted electromagnetic environment, and even to avoid destruction of components which operate at lower and lower voltages.

At present the main solution to this problem is to filter such interference by means of localized components; the latter are placed at the input of each system to be protected or at the output of the systems generating the interference. However, this method has the drawback that it increases the cost of the systems, increases the size of the system and cannot prevent the cables acting as antennas.

An object of the present invention is to provide a cable with the intrinsic property of absorbing electromagnetic interference generated by the electronic components or connecting cables in telecommunication systems.

SUMMARY OF THE INVENTION

The present invention consists in a coaxial cable intended to be used in the field of telecommunications comprising a metal core surrounded by at least two layers one of which is a dielectric material layer and the other of which, disposed between said core and said dielectric material layer over at least part of the length of the cable, is a semiconductor composite material layer comprising an insulative matrix and an undoped polymeric conductor containing conjugated bonds, said cable thereby constituting a cable with intrinsic filtering of electromagnetic interference conducted by the cable at frequencies below 1 GHz.

The composite material has the property of absorbing electromagnetic interference conducted by the metal core of the cable. This is a non-linear property dependent on the frequency of the interference. Electromagnetic interference is not attenuated for some values of frequency, these corresponding to the passband of the composite material layer.

The composite material layer is provided over at least part of the length of the cable. It can be provided over the entire length of the cable or over some sections only of the cable.

The dielectric material and the insulative matrix of the composite material layer are preferably different in order to limit diffusion of the polymer into the dielectric material.

The undoped polymeric conductor is selected from an electronic polymeric conductor, an ionic polymeric conductor, a zwitterionic polymeric conductor and a ferromagnetic polymer such as a copolymer of aniline and naphthalene, for example.

The electronic polymeric conductor is preferably chosen from polymers and copolymers based on aniline and thiophene, pyrole, fullerene (zero dimension crystallized carbon), phenylene-vinylene, phenylene-sulfide, isothionaphthene and derivatives thereof.

The zwitterionic polymeric conductor is preferably chosen from polymers and copolymers based on sulfobetaine and its derivatives.

The proportion of the polymer is in excess of 5% by volume of the composite material. The optimum proportion of the polymer in the matrix is in the vicinity of the percolation threshold. This threshold depends on the nature of the polymer used; in most cases it exceeds 20%. As the loading rate increases up to the percolation threshold the attenuation of interference is increasingly effective. Beyond this threshold the increase in attenuation is much lower.

In one embodiment of the invention the composite material further contains a conductive additive selected from a doped or self-doped polymer, a carbon black loading and a metallic loading. The additive is introduced in proportions less than 10% by volume of the composite material.

The thickness of the composite material layer is between 0.1 times and twice the thickness of the dielectric material layer. Below this value absorption is insufficient whilst above this value any increase in thickness has no effect. The higher this ratio of thicknesses is, the better attenuation will be.

In one embodiment of the invention the metal core of the cable is surrounded by a plurality of layers of composite materials of different composition and/or thickness and these composite material layers are covered with at least one dielectric material layer.

Each composite material layer can be independently disposed along the entire length of the cable or along some sections only of the cable. These layers can be of the same or different thicknesses along the length of the cable.

Electromagnetic interference is absorbed in a frequency range which depends on the nature of the polymer and the thickness of the composite material layer. By varying the thickness it is possible to operate on the relaxation phenomena (modification of the resistance and capacitance per unit length of the layer) and thus to shift the passband of the filter cable.

The conditions governing absorption by each composite material layer are defined by its thickness and by the nature and the proportion of the polymer constituting it. Superposing a plurality of layers with different characteristics allows the cable passband to be adjusted to suit particular requirements.

A cable of this kind is intended to be used in the field of telecommunications. This type of cable has more specific advantages in low-voltage and medium-voltage applications (i.e. below 100 Volts), for which the frequency of conducted electromagnetic interference varies between 100 kHz and 1 GHz.

Filter cables according to the invention have other advantages in terms of electromagnetic compatibility:

- they reduce coupling between cables by absorbing unwanted voltages,
- they have improved performance in terms of emission of radiated interference because they filter unwanted high-frequency currents.

The invention is described in more detail and other advantages and features of the invention are explained in the following description of embodiments of the invention given by way of non-limiting illustrative example only with reference to the appended drawings.

DETAILED DESCRIPTION OF THE PREFERRED EMBODIMENTS

Figure 2:
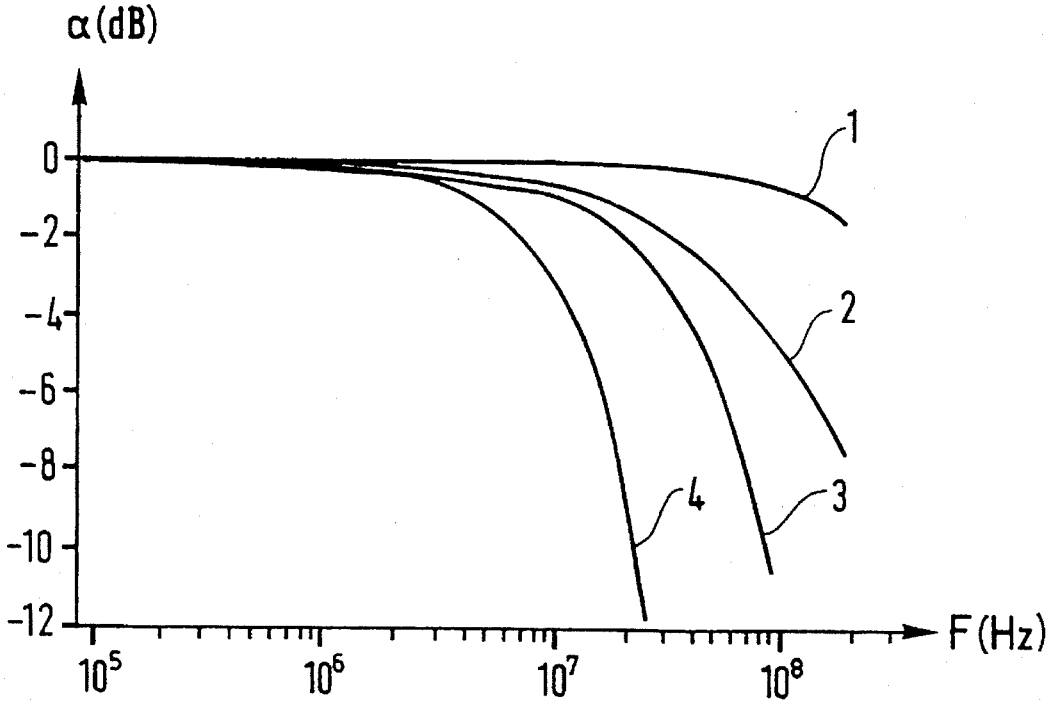
FIG. 2 shows the attenuation of electromagnetic interference as a function of frequency for various composite materials.
Figure 3:
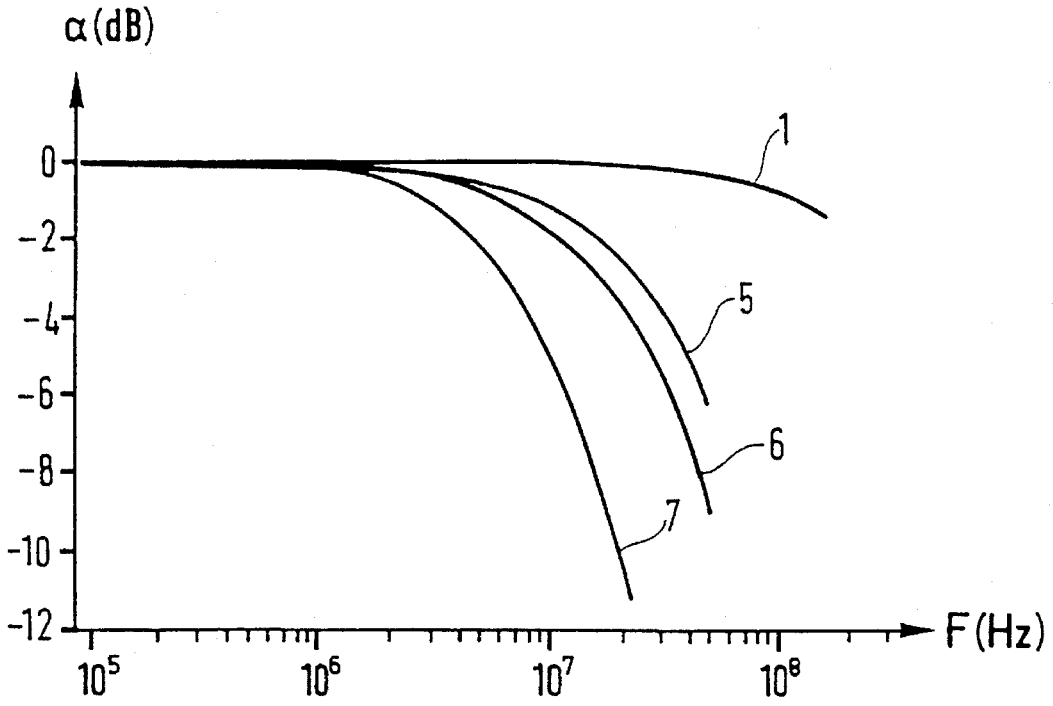
FIG. 3 is analogous to FIG. 2 for other materials.
Figure 4:
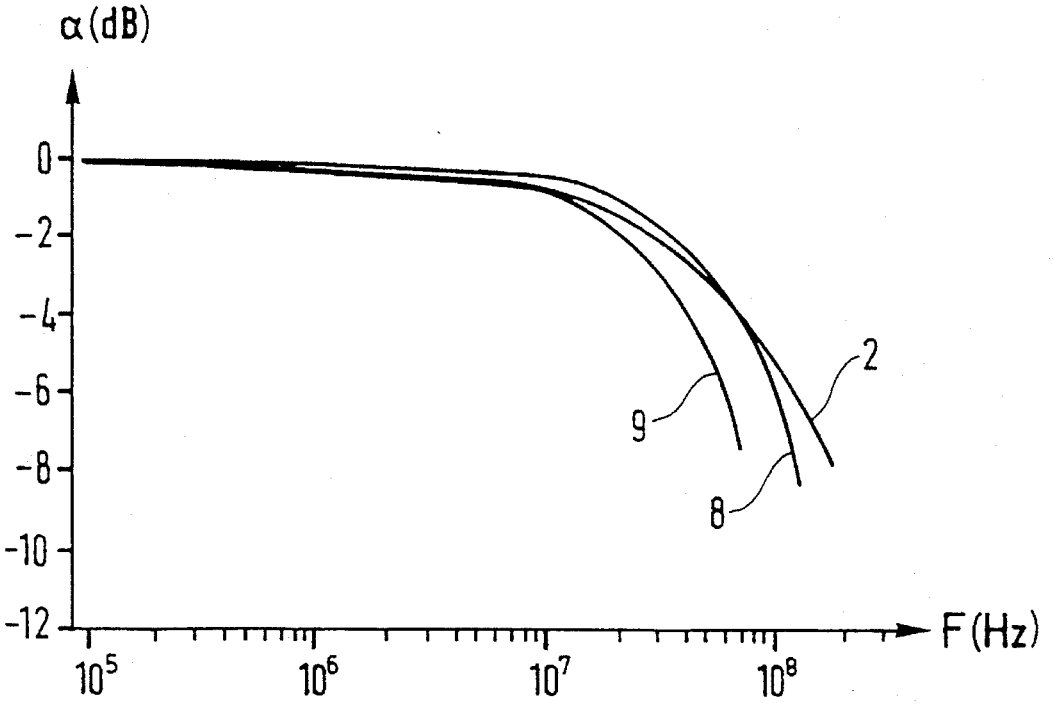
FIG. 4 is analogous to FIG. 2 for materials containing de-doped and doped polythiophene.

In FIGS. 2 to 4 the attenuation $\alpha$ in decibels (dB) is plotted on the ordinate axis and the frequency F in Hertz (Hz) is plotted on the abscissa axis.

Figure 1:
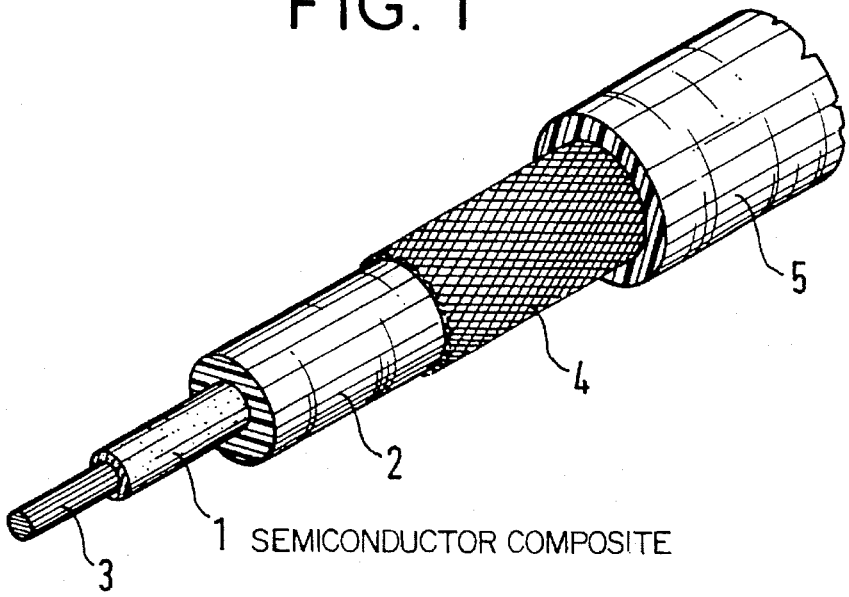
FIG. 1 shows one example of a cable structure according to the invention.

FIG. 1 shows one example of a cable structure according to the invention: a 0.6 mm thick layer of semiconductor composite material 1 and a 2 mm thick layer of dielectric material 2 surround concentrically the metal central core 3 of a 1.38 mm outside diameter cable. The ground return of the coaxial structure is provided by a metal braid 4.

The composite material layer 1 is not grounded, which prevents any interference current flowing in this layer. Also, the skin thickness in the range of frequencies of interest ($\delta=1.6.10^{-2}$ m at 200 MHz) is much greater than the thickness of the composite material layer, which reduces absorption of external interference. Consequently, the efficacy of the semiconductor material layer as a shield is insufficient.

The cable is manufactured by co-extrusion. A heat-shrink jacket 5 protects the cable and holds the structure together.

The dielectric material is conventionally a low-density polyethylene (ATOCHEM "LLDPE AT05600") with no peroxide. This material is a perfect dielectric in the frequency range of interest (100 kHz to 1 GHz).

EXAMPLE 1

A cable with a structure similar to that shown in FIG. 1 was manufactured using a conventional semiconductor layer based on carbon black as the composite material layer. The material comprised an insulative matrix based on a copolymer of ethylene and butyl acrylate (EBA) loaded with acetylene black in a proportion of 25% by volume.

Curve 1 in FIG. 2 shows the measured signal attenuation as a function of frequency. The attenuation at 100 MHz was extremely low.

EXAMPLE 2

A cable according to the invention with a structure similar to that shown in FIG. 1 was made. The composite material comprised an insulative matrix of a copolymer of ethylene and vinyl acetate (EVA) ("ELVAX 260"), containing 26% vinyl acetate to favor sealing and loaded with de-doped polythiophene in a proportion of 30% by volume.

The EVA matrix, different from the dielectric material, was chosen because it has a high load factor and its extrusion temperature is compatible with the intended load materials.

Curve 2 in FIG. 2 shows the measured signal attenuation as a function of frequency. For a 3.7 m long cable the attenuation at 50 MHz was 3 dB and the attenuation at 100 MHz was 5 dB.

EXAMPLE 3

A cable according to the invention with a structure similar to that shown in FIG. 1 was made. The composite material, similar to that described for example 2, comprised an EVA insulative matrix loaded with de-doped polyaniline in a proportion of 30% by volume.

Curve 3 in FIG. 2 shows the measured attenuation of the signal as a function of frequency. The attenuation at 30 MHz was 3 dB and the attenuation at 100 MHz was 10 dB.

EXAMPLE 4

A cable according to the invention with a structure similar to that shown in FIG. 1 was made. The composite material, similar to that described for example 2, comprised an EVA insulative matrix loaded with a ferromagnetic copolymer of aniline and naphthalene in a proportion of 30% by volume.

Curve 4 in FIG. 2 shows the measured attenuation of the signal as a function of frequency. The attenuation was 3 dB at 10 MHz.

EXAMPLE 5

A cable according to the invention with a structure similar to that shown in FIG. 1 was made. The composite material, similar to that described for example 2, comprised an EVA insulative matrix loaded with undoped ionic polymeric conductor in a proportion of 20% by volume. The polymer was obtained by mixing a solution based on $K^+$ alkaline cation and polyoxyethylene $(—CH_2—CH_2—O—)_n$. The polyoxyethylene complexes the $K^+$ ion which provides the conductivity of the polymer obtained.

Curve 5 in FIG. 3 shows the measured attenuation of the signal as a function of frequency. The attenuation was 3 dB at 30 MHz.

EXAMPLE 6

A cable according to the invention with a structure similar to that shown in FIG. 1 was made. The composite material, similar to that described for example 2, comprised an EVA insulative matrix loaded with de-doped polymeric conductor in a proportion of 30% by volume and 5% of zwitterions in the molecular state.

Curve 6 in FIG. 3 shows the measured attenuation of the signal as a function of frequency. The attenuation was 3 dB at 20 MHz.

EXAMPLE 7

A cable according to the invention with a structure similar to that shown in FIG. 1 was made. The composite material, similar to that described for example 2, comprised an EVA insulative matrix loaded with de-doped polymeric conductor in a proportion of 30% by volume and 10% PVDF.

Curve 7 in FIG. 3 shows the measured attenuation of the signal as a function of frequency. The attenuation was 3 dB at 7 MHz.

EXAMPLE 8

A cable according to the invention with a structure similar to that shown in FIG. 1 was made. The composite material, similar to that described for example 2, comprised an EVA insulative matrix loaded with fullerenes in a proportion of 25% by volume.

The attenuation obtained was identical to that obtained in example 2 for polythiophene (curve 2 in FIG. 2).

It is equally feasible to use grafted fullerenes, for example bromophenylfulleroids, nitrosated fullerene compounds, fullerene copolymers (in particular xylylene) and metallofullerenes.

EXAMPLE 9

A cable according to the invention with a structure similar to that shown in FIG. 1 was made. The composite material, similar to that described for example 2, comprised an EVA insulative matrix loaded with de-doped polythiophene in a proportion of 30% by volume and 5% doped polythiophene.

Curve 8 in FIG. 4 shows the measured attenuation of the signal as a function of frequency. The attenuation was 3 dB at 50 MHz.

EXAMPLE 10

A cable according to the invention with a structure similar to that shown in FIG. 1 was made. The composite material, similar to that described for example 2, comprised an EVA insulative matrix loaded with de-doped polythiophene in a proportion of 30% by volume and 10% of doped polythiophene.

Curve 9 in FIG. 4 shows the measured attenuation of the signal as a function of frequency. The attenuation was 3 dB at 40 MHz.

Of course, the present invention is not limited to the embodiments described and shown, but is subject to variation by the person skilled in the art without departing from the scope of the invention. In particular, the cable can be covered externally with one or more further layers such as an electromagnetic shielding layer, a colored identifying material layer, a fireproof protection layer, etc.

There is claimed:

1. Coaxial cable intended to be used in the field of telecommunications comprising a metal core surrounded by at least two layers, one of which is a dielectric material layer and the other of which, disposed between said core and said dielectric material layer over at least part of the length of the cable, is a semiconductor composite material layer comprising an insulative matrix and an undoped polymeric conductor containing conjugated bonds selected from an ionic conductive polymer, a ferromagnetic polymer, and an electronic polymeric conductor selected from polymer and copolymers based on aniline, thiophene, pyrole, fullerene, phenylene-vinylene and isothionaphthene, wherein said cable constitutes a cable with intrinsic filtering of electromagnetic interference conducted by the cable at frequencies below 1 GHz.

2. Cable according to claim 1 wherein the proportion of said polymer exceeds 5% by volume of said composite material.

3. Cable according to claim 1 wherein said composite material further contains a conductive additive selected from a doped or self-doped polymeric conductor, a carbon black loading and a metal loading, said additive being present in proportions of less than 10% by volume of said composite material.

4. Cable according to claim 1 wherein the thickness of said composite material layer is between 0.1 times and twice the thickness of said dielectric material layer.

5. Cable according to claim 1 wherein said core is surrounded by a plurality of layers of composite materials having different composition and/or thickness, said composite material layers being covered with at least one dielectric material layer.

6. Coaxial cable intended to be used in the field of telecommunications comprising a metal core surrounded by at least two layers, one of which is a dielectric material layer and the other if which, disposed between said core and said dielectric material layer over at least part of the length of the cable, is a semiconductor composite material layer comprising an insulative matrix and an undoped polymeric conductor containing conjugated bonds, which is a zwitterionic polymeric conductor selected from polymers and copolymers based on sulfobetaine and its derivatives, wherein said cable constitutes a cable with intrinsic filtering of electromagnetic interference conducted by the cable at frequencies below 1 GHz.

7. Cable according to claim 6 wherein the proportion of said polymer exceeds 5% by volume of said composite material.

8. Cable according to claim 6 wherein said composite material further contains a conductive additive selected from a doped or self-doped polymeric conductor, a carbon black loading and a metal loading, said additive being present in proportions of less than 10% by volume of said composite material.

9. Cable according to claim 6 wherein the thickness of said composite material layer is between 0.1 times and twice the thickness of said dielectric material layer.

10. Cable according to claim 6 wherein said core is surrounded by a plurality of layers of composite materials having different composition and/or thickness, said composite material layers being covered with at least one dielectric material layer.

11. Telecommunications device containing a coaxial cable comprising a metal core surrounded by at least two layers, one of which is a dielectric material and the other of which, disposed between said core and said dielectric material layer over at least part of the length of the cable, is a semiconductor composite material layer comprising an insulative matrix and an undoped polymeric conductor containing conjugated bonds selected from an ionic conductive polymer, a ferromagnetic polymer, and an electronic polymeric conductor selected from polymer and copolymers based on aniline, thiophene, pyrole, fullerene, phenylene-vinylene and isothionaphthene, wherein said cable constitutes a cable with intrinsic filtering of electromagnetic interference conducted by the cable at frequencies below 1 GHz.

12. Device according to claim 11 wherein the proportion of said polymer exceeds 5% by volume of said composite material.

13. Device according to claim 11 wherein said composite material further contains a conductive additive selected from a doped or self-doped polymeric conductor, a carbon black loading and a metal loading, said additive being present in proportions of less than 10% by volume of said composite material.

14. Device according to claim 11 wherein the thickness of said composite material layer is between 0.1 times and twice the thickness of said dielectric material layer.

15. Device according to claim 11 wherein said core is surrounded by a plurality of layers of composite materials having different composition and/or thickness, said composite material layers being covered with at least one dielectric material layer.

16. Telecommunications device containing a coaxial cable comprising a metal core surrounded by at least two layers, one of which is a dielectric material and the other of which, disposed between said core and said dielectric material layer over at least part of the length of the cable, is a semiconductor composite material layer comprising an insulative matrix and an undoped polymeric conductor containing conjugated bonds, which is a zwitterionic polymeric conductor selected from polymers and copolymers based on sulfobetaine and its derivatives, wherein said cable constitutes a cable with intrinsic filtering of electromagnetic interference conducted by the cable at frequencies below 1 GHz.

17. Device according to claim 16 wherein the proportion of said polymer exceeds 5% by volume of said composite material.

18. Device according to claim 16 wherein said composite material further contains a conductive additive selected from a doped or self-doped polymeric conductor, a carbon black loading and a metal loading, said additive being present in proportions of less than 10% by volume of said composite material.

19. Device according to claim 16 wherein the thickness of said composite material layer is between 0.1 times and twice the thickness of said dielectric material layer.

20. Device according to claim 16 wherein said core is surrounded by a plurality of layers of composite materials having different composition and/or thickness, said composite material layers being covered with at least one dielectric material layer.

* * * * *